US011623838B2

(12) United States Patent
McDonald et al.

(10) Patent No.: US 11,623,838 B2
(45) Date of Patent: Apr. 11, 2023

(54) METAL SQUARING TABLE

(71) Applicant: M.J. Lathern Co., Inc., Hewitt, TX (US)

(72) Inventors: Daniel McDonald, Hewitt, TX (US); Damian McDonald, Hewitt, TX (US)

(73) Assignee: M.J. Lathern Co., Inc., Hewitt, TX (US)

( * ) Notice: Subject to any disclaimer, the term of this patent is extended or adjusted under 35 U.S.C. 154(b) by 0 days.

(21) Appl. No.: 17/181,557

(22) Filed: Feb. 22, 2021

(65) Prior Publication Data

US 2021/0261376 A1 Aug. 26, 2021

Related U.S. Application Data

(60) Provisional application No. 62/980,219, filed on Feb. 22, 2020.

(51) Int. Cl.

| | |
|---|---|
| ***B65H 31/34*** | (2006.01) |
| ***B65H 31/02*** | (2006.01) |
| *B65H 31/30* | (2006.01) |

(52) U.S. Cl.

CPC ..... *B65H 31/34* (2013.01); *B65H 31/02* (2013.01); *B65H 31/3063* (2013.01); *B65H 2701/173* (2013.01)

(58) Field of Classification Search

CPC .... B65H 31/34; B65H 31/02; B65H 31/3063; B65H 2701/173; B21D 5/002; B21D 43/00; B21D 43/003; B23K 37/0408; B23Q 3/18; B23Q 3/186; B25H 1/02

USPC ..... 29/559

See application file for complete search history.

(56) References Cited

U.S. PATENT DOCUMENTS

| | | | | | |
|---|---|---|---|---|---|
| 1,008,651 | A * | 11/1911 | Korff | B65H 31/34 | 271/221 |
| 2,649,302 | A * | 8/1953 | Johnson | B65H 31/18 | 271/215 |
| 4,177,702 | A * | 12/1979 | Pazzaglia | B65H 31/3018 | 83/79 |
| 4,319,743 | A * | 3/1982 | Rood | B65H 31/34 | 271/236 |
| 4,543,970 | A * | 10/1985 | Noh | B23Q 11/0042 | 134/76 |
| 4,589,654 | A * | 5/1986 | Kanoto | B65H 31/36 | 271/236 |
| 6,065,747 | A * | 5/2000 | Khovaylo | B65H 31/02 | 271/209 |
| 8,464,438 | B2 * | 6/2013 | Fujikura | B65H 31/20 | 34/619 |
| 9,708,141 | B2 * | 7/2017 | Kishi | B65H 31/3081 | |
| 10,850,348 | B2 * | 12/2020 | Lin | B23K 37/0408 | |
| 2006/0059673 | A1 * | 3/2006 | Ou | B62B 3/06 | 29/468 |
| 2015/0368059 | A1 * | 12/2015 | Nakayama | B65H 31/3045 | 271/220 |
| 2022/0088668 | A1 * | 3/2022 | Lim | B21J 5/06 | |

* cited by examiner

FOREIGN PATENT DOCUMENTS

| | | | |
|---|---|---|---|
| KR | 101810554 | B1 * | 12/2017 |
| KR | 101203620 | B1 * | 11/2021 |

*Primary Examiner* — Leslie A Nicholson, III

(74) *Attorney, Agent, or Firm* — Naman, Howell, Smith & Lee; John A. Powell

(57) ABSTRACT

A table for squaring metal sheets and metal plates by means of applying controlled pressure to the edges of such sheets or plates to bring them into symmetrical alignment for further processing.

14 Claims, 11 Drawing Sheets

METAL SQUARING TABLE

PRIORITY CLAIM

This application claims priority to U.S. Provisional Application No. 62/980,219 filed on Feb. 22, 2020, which is hereby incorporated by reference.

TECHNICAL FIELD OF THE INVENTION

The present invention is generally directed to an apparatus that can be used to symmetrically align stacked sheet metal or metal plate for further processing in metal fabrication work.

BACKGROUND ART OF THE INVENTION

In metal fabrication work, it is often necessary to stack metal sheets or metal plates symmetrically for further processing. For instance, metal sheets or metal plates that are to be fed into a precision laser cutter or into another type of automated metal fabrication machine are frequently required to be loaded into such machines in symmetrically aligned stacks before they can be processed by such machines and thereby turned into desired metal components or metal parts having a size and/or shape that is different than the metal sheets or metal plates that are initially fed into the machines. Laser cutters and other metal fabrication machines often are equipped with one or more sensors that will only allow symmetrically stacked metal sheets or metal plates to be processed by such machines, and the sensors' detection of non-symmetrically stacked sheets or plates that have been fed or loaded into the machines with edges that are not aligned from the top to the bottom of the stack will often cause the machine to simply turn itself off or stop functioning, resulting in factory down time and loss of efficiency and consequential loss of profit.

Metal sheets and metal plates are generally delivered to metal fabricators in stacks, but the metal sheets or metal plates are typically not symmetrically stacked when they are delivered. In other words, the edges of the metal sheets or metal plates as delivered are not precisely aligned from the top sheet or top plate to the bottom sheet or bottom plate in the stacks when they are delivered. In order to place metal sheets or metal plates into a symmetrically stacked arrangement for feeding into laser cutters or other automated fabrication machines that require relatively precisely, symmetrically stacked sheets or plates for further processing, workers will often use mallets, sledge hammers, or other manually operated tools to physically strike the edges of the stacked metal sheets or plates in order to align the edges of all the sheets or plates so that the stack of sheets or plates is made symmetrical. This process is generally referred to as manual squaring. Although squaring the metal sheets or plates with manual tools does generally work to align all the edges of the metal sheets or metal plates in a stack from top to bottom, it is a very cumbersome process and often takes an excessive amount of time and labor. Further, in a worst case scenario that sometimes occurs, because manual striking may deliver varying impacts at varying angles in relation to the edges of the metal sheets or metal plates in the initial, non-symmetrical stack, squaring the metal sheets or metal plates by such manual means may result in physical damage to the edges of some of the sheets or plates in the stack, which can further complicate or disrupt processing by the cutter or fabricator. It is desirable to eliminate such wastes of time, energy and labor and to avoid any potential disruption to fabrication activities that can result from manual squaring of metal sheets and metal plates.

SUMMARY OF THE INVENTION

The invention hereby disclosed is a table for squaring metal sheets and metal plates (sometimes referred to as a "metal squaring table") that may be used to convert a group of non-symmetrically stacked metal sheets or metal plates into a symmetrical stack of sheets or plates for loading into a laser cutter or other automated metal fabrication machine that requires loading of symmetrically aligned stacks for its metal fabrication operations. The metal squaring table hereby described and disclosed can be used to safely and efficiently square a non-symmetrical stack of metal sheets or metal plates and change it into a symmetrical stack of the same metal sheets or plates in which all of the edges of the individual sheets or plates are aligned and the main planar faces of the metal sheets or metal plates are stacked one on top of the other. The symmetrical stacks of metal sheets or metal plates produced by use of the metal squaring table hereby described will be such that the perimeter of each sheet or plate in the properly squared stack would occupy the same footprint from top to bottom.

The squaring table hereby disclosed is comprised of a flat table having a top planar surface, raised walls located on, and rigidly affixed to, at least two orthogonal edges of the table (one raised wall per orthogonal edge), one or more pushing rams that are movable across the top planar surface of the table towards the raised walls, and means for forcing/actuating the one or more pushing rams to move toward the raised walls. A non-symmetrically stacked group of square or rectangular metal sheets or metal plates is the workpiece upon which the metal squaring table will operate. In practice, a non-symmetrically stacked stack of metal sheets or metal plates is placed on top of the metal squaring table in the space located between the at least two raised walls and the one or more rams that are capable of movement across the planar surface of the table toward the raised walls. This placement of the non-symmetrical stack of metal sheets or metal plates onto the top planar surface of the squaring table is typically accomplished using a loader device such as a forklift, front-end loader, or crane. During the squaring process that follows, the pushing rams are moved across the top planar surface of the table toward the raised walls by the forcing/actuation means that motivate the one or more pushing rams forward towards the raised walls. When the ends of the rams come into contact with non-aligned edges of the metal sheets or metal plates in the non-symmetrically aligned stack, the rams apply pressure to those edges and thereby push all the individual sheets or plates in the stack in a controlled fashion against the raised walls. Because the raised walls are rigidly affixed to orthogonal edges of the table and are therefore orthogonal to each other, the individual rectangular or square metal sheets or metal plates will be pushed against and squared against the orthogonal raised walls, with the result that the stack of metal sheets or metal plates is brought into a symmetrical alignment with all edges of all sheets or plates in the stack now in alignment with each other from top to bottom and thus the stack of metal sheets or metal plates is now ready for loading into a laser cutter or other fabrication machine for further processing. The now symmetrically aligned stack of sheets or plates is typically removed from the squaring table using a forklift, front-end loader, crane, or other loader and then transported for loading into the laser cutter or other metal fabrication machine.

The invention may best be understood with reference to the appended drawings, as described below.

BRIEF DESCRIPTION OF THE DRAWINGS

The following description is to be read in conjunction with the identified drawing figures that are included as a part of this patent application.

DETAILED DESCRIPTION OF THE INVENTION

Figure 1:
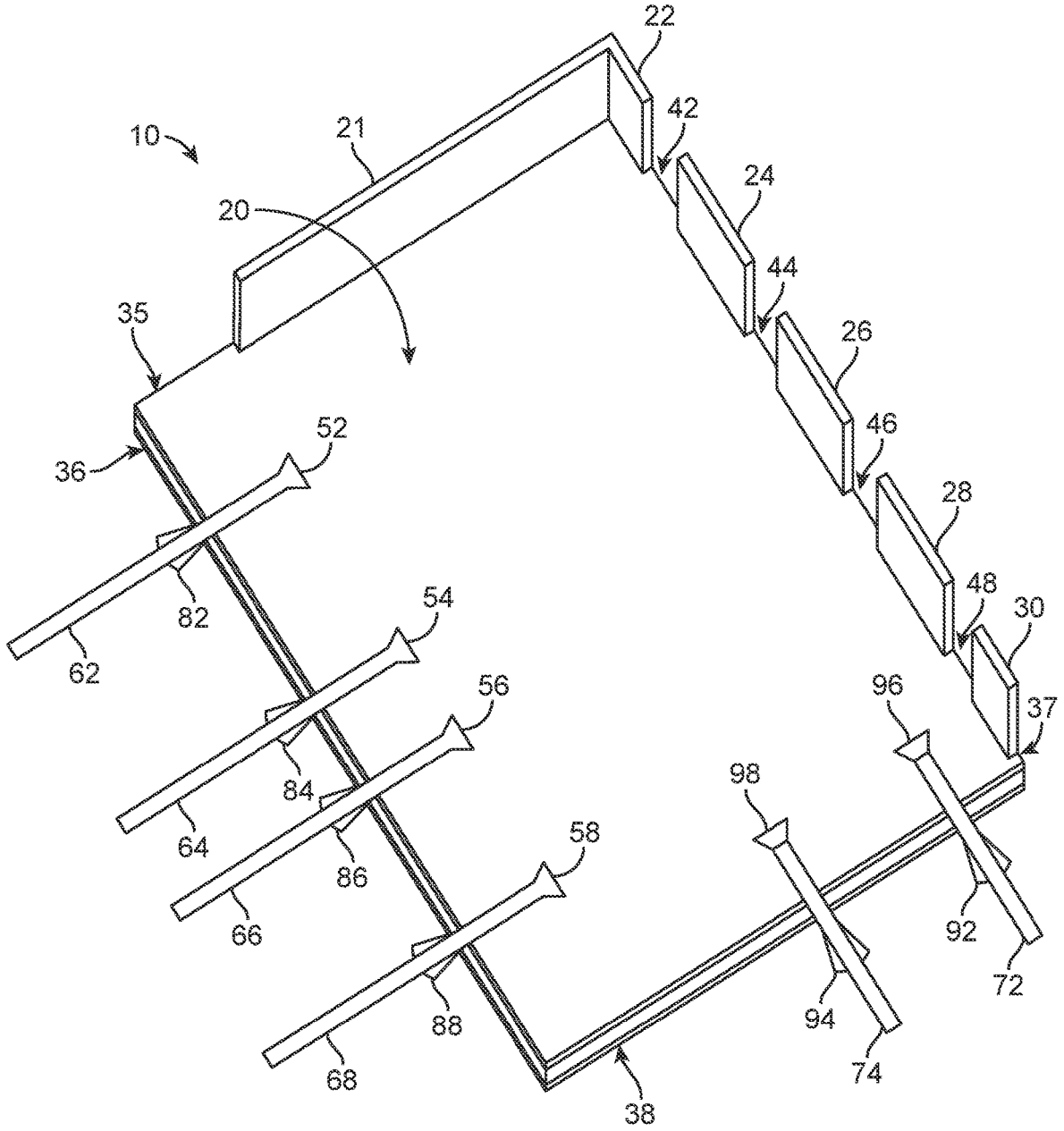
FIG. 1 is a top perspective view of the metal squaring table.

FIG. 1 is a perspective view of an embodiment of the squaring table 10 comprising a top planar surface 20 and at least two raised walls 21, 22 that are orthogonal to each other and are rigidly affixed to respective orthogonal edges 35, 37 of the table 10. In a preferred embodiment, the table 10 additionally features a multiplicity of raised walls 22, 24, 26, 28, 30 that are rigidly affixed along one of the orthogonal edges 37 of the table 10, with said multiplicity of raised walls 22, 24, 26, 28, 30 being separated from one another by virtue of a multiplicity of wall openings 42, 44, 46, 48 that will provide access to the forks or tines of a loader device, such as a forklift or front-end loader, for placing non-symmetrically stacked metal sheets or metal plates onto the top planar surface 20 of the table 10 prior to squaring operations, and removing the symmetrically stacked stack of metal sheets or metal plates after squaring operations are complete. The table 10 further comprises at least one, and preferably a multiplicity of main pushing rams 62, 64, 66, 68 that are slidably connected to one edge of the table 10, each of said main pushing rams 62, 64, 66, 68 having respective pushing ends 52, 54, 56, 58 that rise vertically above the top planar surface 20 of the table 10, and wherein the main rams 62, 64, 66, 68 may be retractably moved forward across the planar surface 20 toward the one or more raised walls 22, 24, 26, 28 that are located at the opposing orthogonal edge 37 of the table 10 by respective actuation means 82, 84, 86, 88. The table 10 also comprises one or more side pushing rams 72, 74, with respective pushing ends 96, 98 that rise vertically above the top planar surface 20, wherein the side rams 72, 74 may be retractably moved forward across the planar surface 20 toward the at least one raised wall 21 located at the opposing orthogonal edge 35 of the table 10 by respective actuation means 92, 94.

When the embodiment of the squaring table 10 shown in FIG. 1 is in use for squaring a non-symmetrically stacked stack of square or rectangular metal sheets or metal plates whose edges are initially more or less disparately arranged within the stack from top to bottom, a loader device is initially used to place a non-symmetrically stacked stack of sheets or plates onto the top planar surface 20 in the open space that is defined by the one or more pushing ends 52, 54, 56, 58, 96, 98 and the raised walls 21, 22, 24, 26, 28, 30. One or more of the main pushing rams 62, 64, 66, 68 and one or more of the side rams 72, 74 are then moved forward across the planar surface 20 toward the respective opposing raised walls 21, 22, 24, 26, 28, 30 by respective actuation means 62, 64, 66, 68, 72, 74. As one or more of the pushing ends 52, 54, 56, 58, 96, 98 comes into contact with the edges of the individual metal sheets or metal plates in the non-symmetrically aligned stack, the entire sheets or plates are pushed toward the respective raised walls 21, 22, 24, 26, 28, 30, with the result that the individual square or rectangular metal sheets or plates are forced into symmetrical alignment as each plate in the stack is forced into abutment with at least the orthogonally positioned raised walls 21, 22. The now symmetrically aligned stack of metal sheets or metal plates can be removed from the table 10 by a loader device such as a forklift, front end loader, or crane and transported to a laser cutter or other metal fabrication device for loading into that device so that the device can perform metal fabrication work on the sheets or plates that are now in a symmetrically aligned stack.

Figure 2:
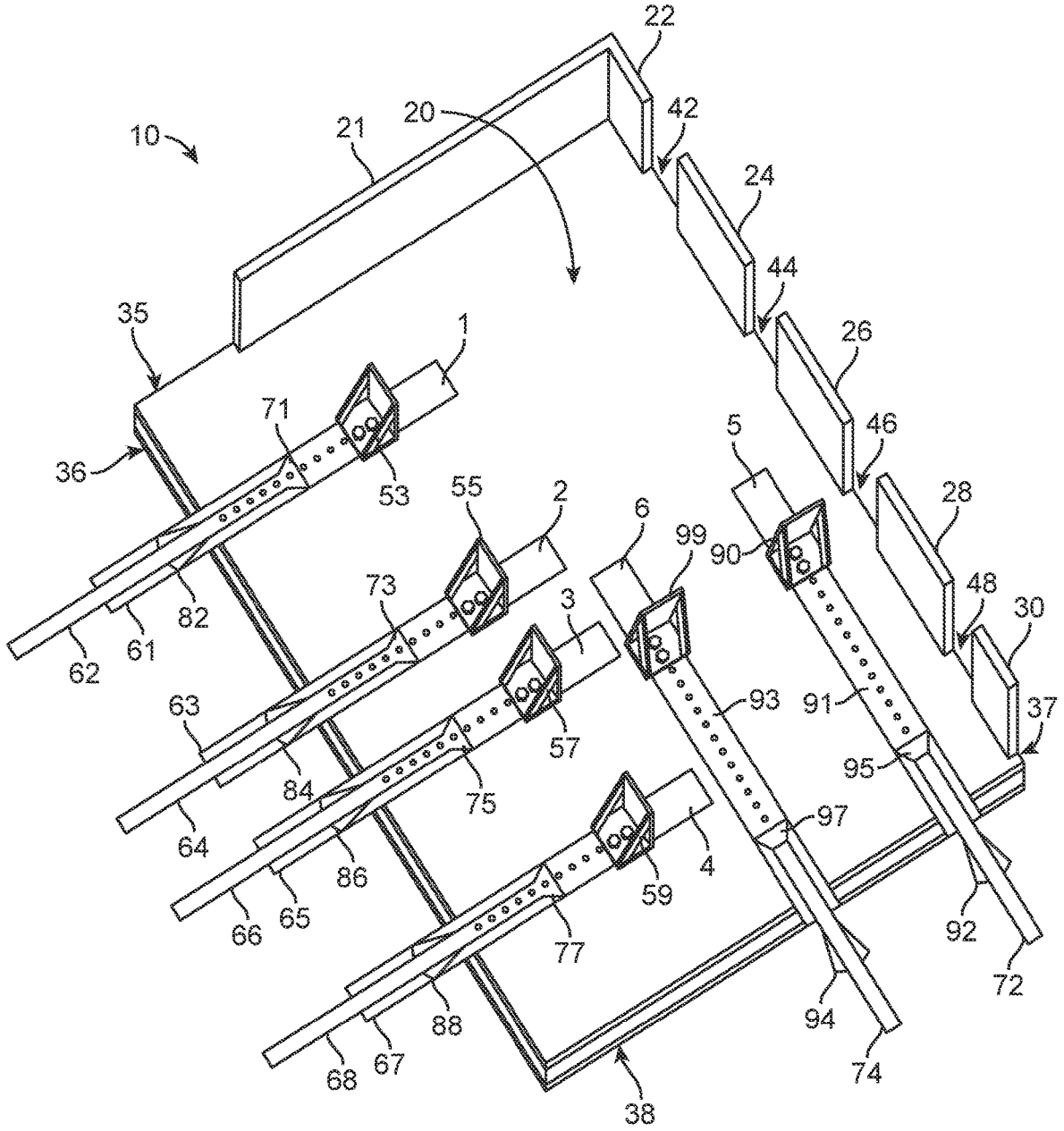
FIG. 2 is a top perspective view of the metal squaring table with additional detailed images involving the pushing rams and actuation means, etc.
Figure 3:
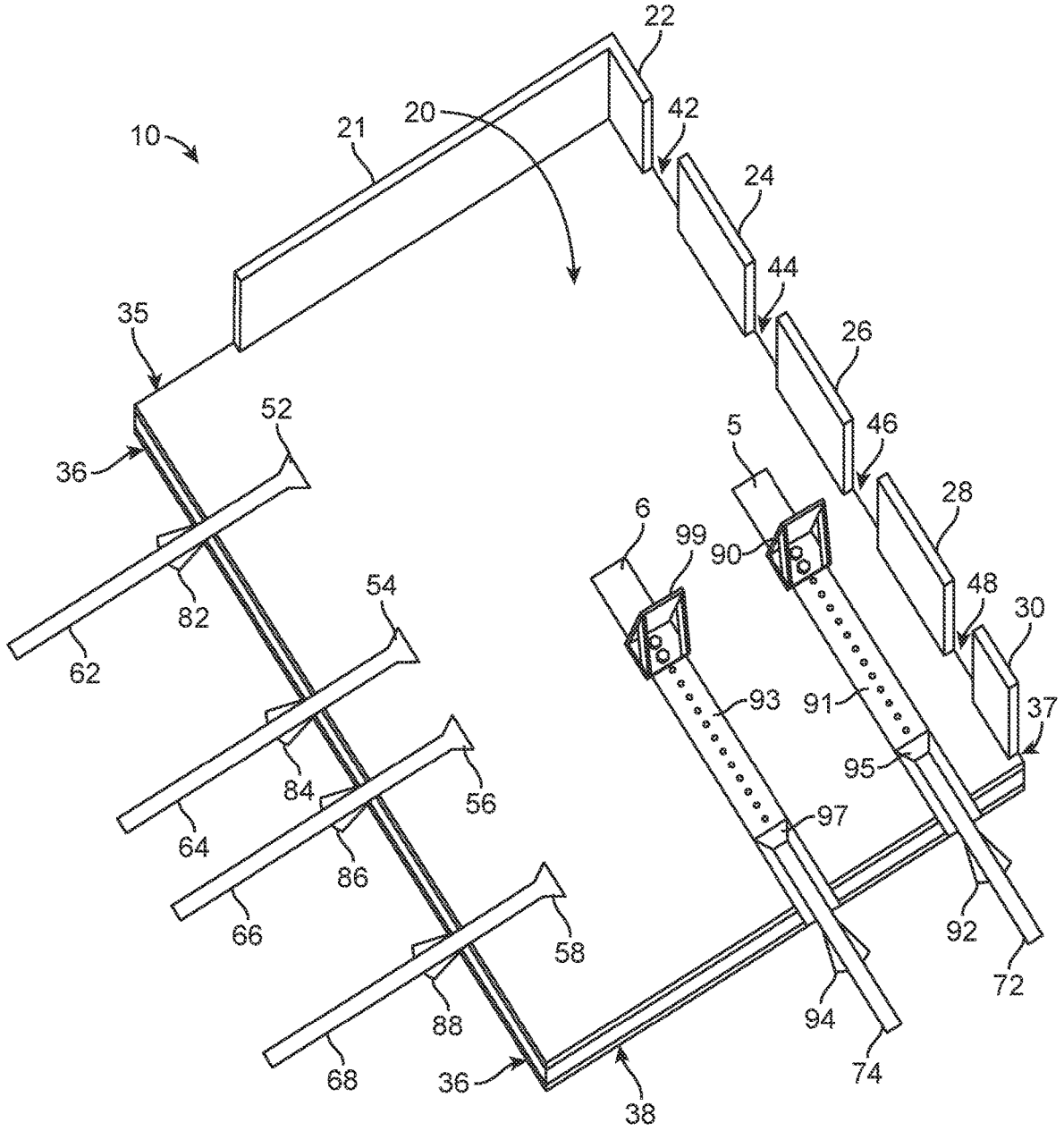
FIG. 3 is a top perspective view of the metal squaring table.

FIG. 2 and FIG. 3 illustrate embodiments of the squaring table 10 that are slightly different from the embodiment illustrated in FIG. 1. In FIG. 2, the one or more main pushing rams 62, 64, 66, 68 are removably attached by respective slide connectors 71, 73, 75, 77 by removable connection means such as bots or pins to respective main slide plates 61, 63, 65, 67 that are slidably disposed within respective main slide wells 1, 2, 3, 4 that are recessed channels within the top planar surface 20 of the squaring table 10. During squaring operations, one or more of the respective main actuation means 82, 84, 86, 88 force the respective one or more main rams 62, 64, 66, 68 forward. The forward force applied to the one or more main rams 62, 64, 66, 68 is transmitted to the one or more respective main slide plates 61, 63, 65, 67 by means of respective slide connectors 71, 73, 75, 77 that are removably connected to the main slide plates 61, 63, 65, 67, typically by removable connection members such as pins or bolts. At the distal end of each of the main slide plates 61, 63, 65, 67 are respective, removably connected main push plates 53, 55, 57, 59 that are removably connected to the slide plates 61, 63, 65, 67 by removable connection means such as bolts or pins.

As further shown in FIG. 2, the side pushing rams 72, 74 are removably attached by respective slide connectors 95, 97 to respective side slide plates 91, 93 that are slidably disposed within respective side slide wells 5, 6 that are recessed channels within the top planar surface 20 of the squaring table 10 positioned perpendicularly to the main slide wells 1, 2, 3, 4. During squaring operations, respective side actuation means 92, 94 force the respective one or more side rams 72, 74 forward. The forward force applied to the one or more side rams 72, 74 is transmitted to the one or more respective side slide plates 91, 93 by means of respective slide connectors 95, 97 that are removably connected to the side slide plates 91, 93, typically by removable connection members such as bolts or pins. At the distal end of each of the side slide plates 91, 93 are respective, removably connected side push plates 90, 99 that are also removably connected to the respective side slide plates by means such as bolts or pins. As can be appreciated, during squaring operations, one or more of the main push plates 53, 55, 57, 59, and one or more of the side push plates 90, 99, are pushed forward and are used to apply force to the edges of non-symmetrically stacked metal sheets or metal plates in a controlled manner in which the sheets or plates are pushed toward the raised walls 21, 22, 24, 26, 28, 30 until the edges of all of the metal sheets or metal plates are brought into abutment with at least raised walls 21, 22 and thereby pushed into alignment and the stack is therefore squared and made ready for movement to a laser cutter or other metal fabrication machine for cutting or fabrication work.

FIG. 3 illustrates similar features with regard to the side pushing rams 72, 74. In FIG. 3, side rans 72, 74 are removably connected by respective slide connectors 95, 97 to respective side slide plates 91, 93 that are slidably disposed within respective side slide wells 5, 6 that are recessed channels within the top planar surface 20 of the table 10. Side push plates 90, 99 are removably connected to the distal ends of the side slide plates 91, 93, typically by means of bolts or pins. As actuation means 92, 94 push side pushing rams 72, 74 forward across the planar surface 20, that force is transmitted to the side slide plates 91, 93 by means of the slide connectors 95, 97 with the result that the side push plates 90, 99 are forced forward. During squaring operations, force applied to the edges of non-symmetrically stacked rectangular or square metal sheets or metal plates by the side push plates 90, 99 will force the metal sheets or plates into physical abutment with opposing raised wall 21 located at the opposing edge of the table 10, thereby helping to square the metal sheets or plates as discussed in relation to FIG. 2 above.

Figure 4:
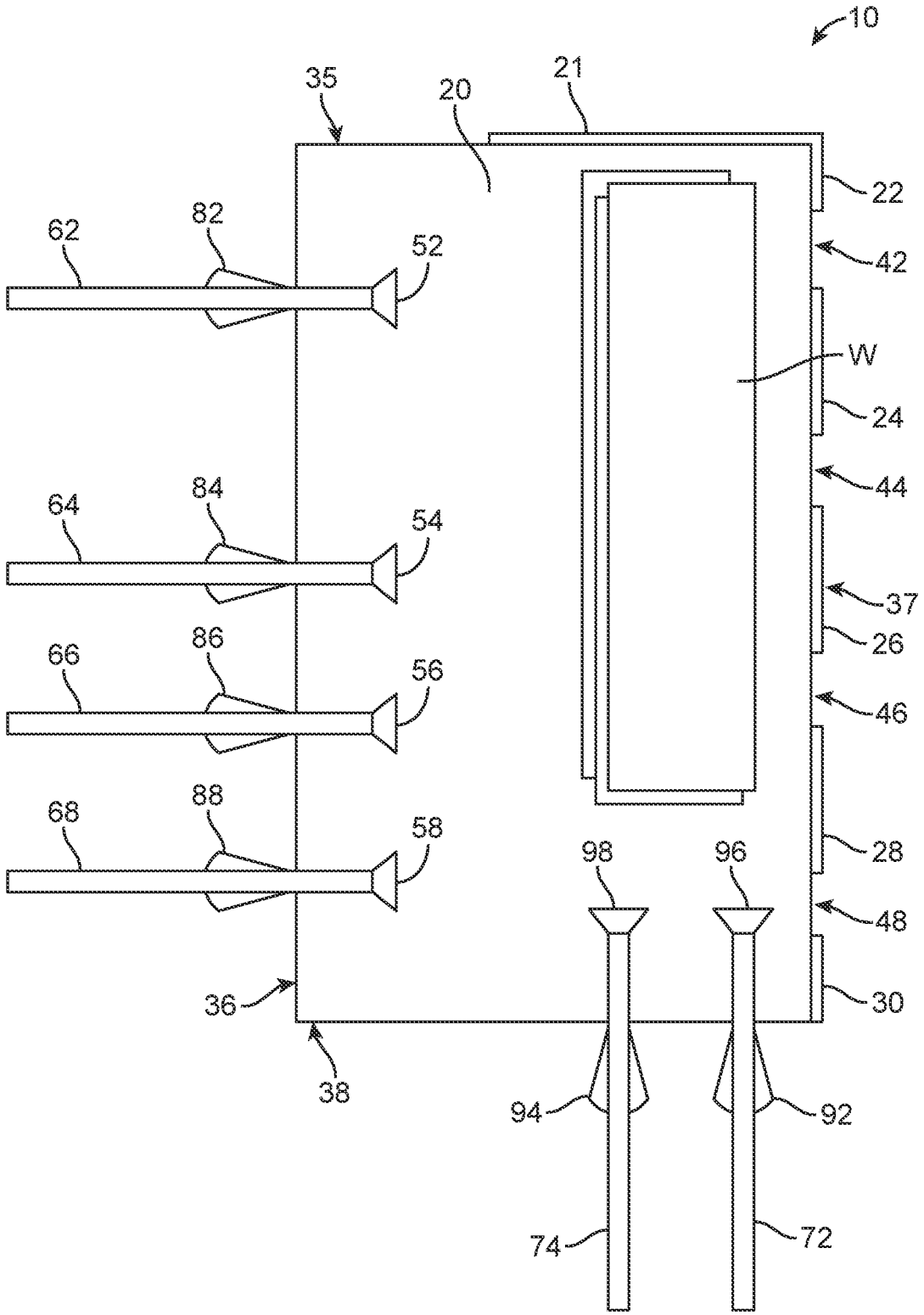
FIG. 4 is a top view of the metal squaring table also showing a non-symmetrically stacked stack of metal plates placed on the metal squaring table.
Figure 5:
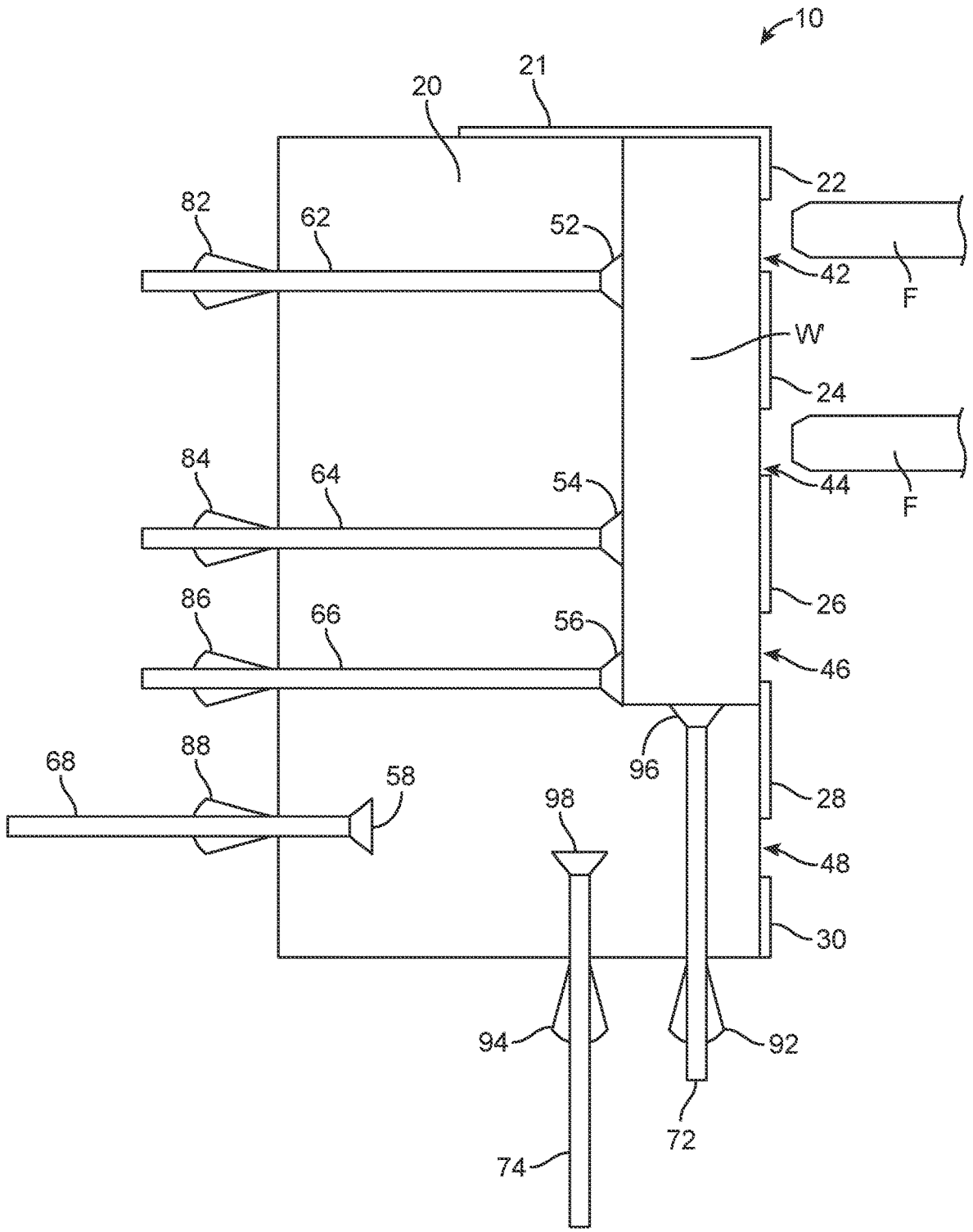
FIG. 5 is a top view of the metal squaring table also showing a symmetrically stacked stack of metal plates located on the metal squaring table.

FIG. 4 is an illustration of the same embodiment of the metal squaring table 10 that was shown in FIG. 1, with the only difference being that a non-symmetrically aligned stack of metal sheets that is the workpiece (W) for the invention has been placed onto the planar surface 20 of the squaring table 10. As can be understood, FIG. 4 is intended to illustrate how the table 10 and the workpiece (W) would appear before squaring operations have begun. FIG. 5 is an illustration of the same embodiment of the squaring table 10 after the conclusion of squaring operations. As shown in FIG. 5, the stack of metal sheets is now symmetrically aligned and is the completed workpiece (W'). As further illustrated in FIG. 5, the completed workpiece (W') can now be carried away from the metal squaring table 10 by means of a loading device, such as by using the forks (F) of a front end loader or forklift that may be inserted through wall openings 42, 44 and underneath the completed workpiece (W') in order to move the now symmetrically aligned stack of metal sheets (W') to a laser cutter machine or other metal fabrication machine.

Figure 6:
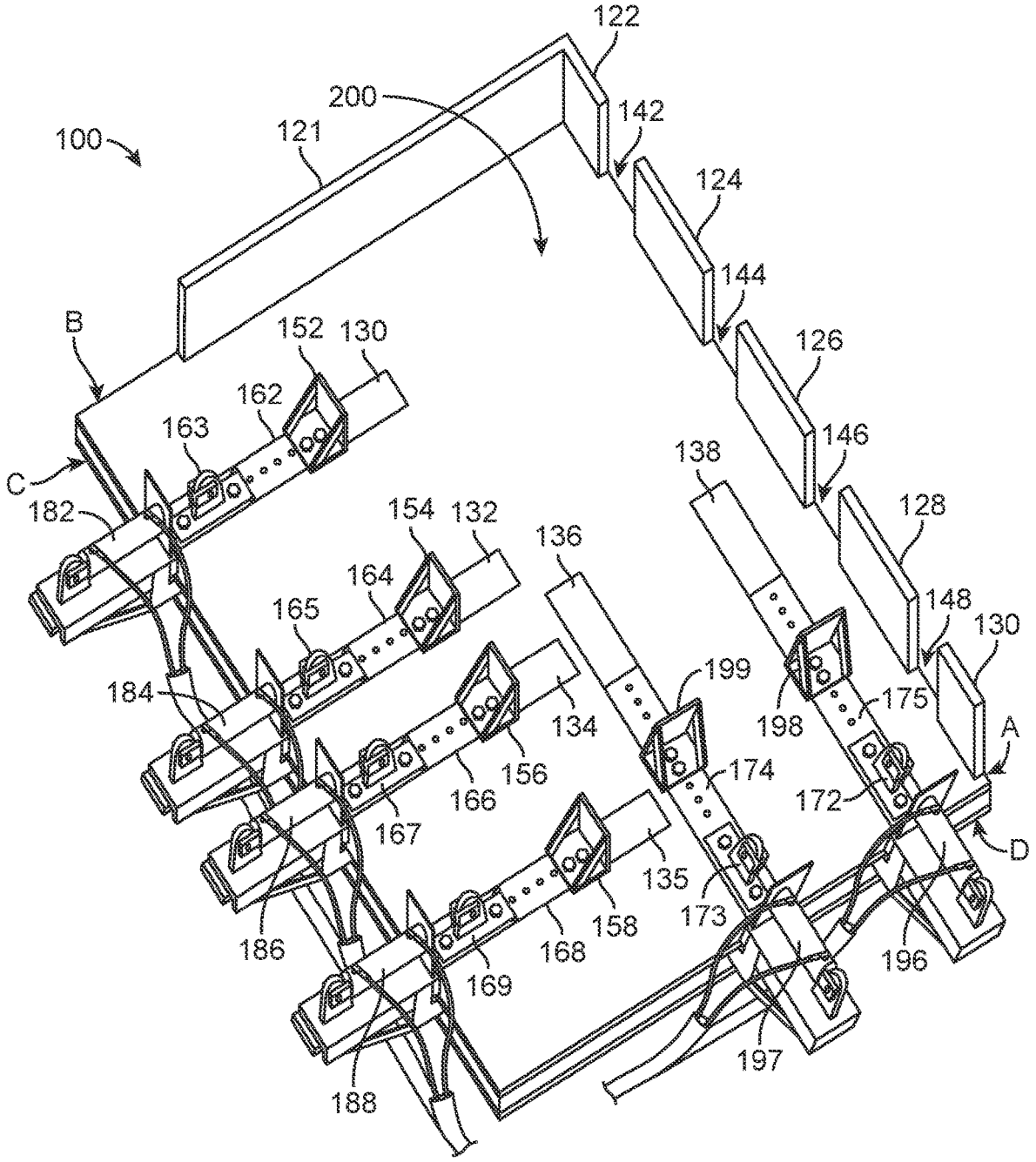
FIG. 6 is a top perspective view of an embodiment of the metal squaring table showing significant detail of various aspects of the embodiment.

FIG. 6 illustrates an embodiment of the invention that is somewhat similar to, though not quite the same as, the embodiment that is shown in FIG. 2. As shown in FIG. 6, a squaring table 100 features one or more raised walls 121, 122, 124, 126, 128, 130 that are rigidly affixed to a pair of orthogonal edges A, B of the table 100, with at least one or more of the raised walls 121, 122, 124, 126, 128, 130 affixed to edge A, and at least one or more of the raised walls 121, 122, 124, 126, 128, 130 rigidly affixed to edge B. As shown in FIG. 6, the raised walls 121, 122, 124, 126, 128, 130 of this embodiment of the squaring table 100 are located only along the pair of orthogonal edges A, B of the table 100. The opposing pair of orthogonal edges C, D of the squaring table 100 feature one or more pushing rams 183, 185, 187, 189, 176, 177 connected on their proximal ends to respective actuation means 182, 184, 186, 188, 197, 196 and removably connected on their distal ends to respective slides 162, 164, 166, 168, 174, 175 by means of respective arm connectors 163, 165, 167, 169, 173, 172 wherein the slides 162, 164, 166, 168, 174, 175 are slidably disposed within recessed channels 130, 132, 134, 135, 136, 138 that are recessed tracks within the planar top planar surface 200 of the table 100. The squaring table 100 further features one or more push pedestals 152, 154, 156, 158, 199, 198 that are removably connected to a distal end of respective slides 162, 164, 166, 168, 174, 175. This embodiment of the squaring table 100 operates in much the same manner as the previously described embodiments in the sense that non-symmetrically stacked metal sheets or metal plates may be placed onto the top planar surface 200 in the open area defined by the raised walls 121, 122, 124, 126, 128, 130 and the push pedestals 152, 154, 156, 158, 199, 198. During squaring operations, one or more of the actuation means 182, 184, 186, 188, 197, 196 push one or more respective pushing rams 183, 185, 187, 189, 173, 175 forward, thereby applying pushing pressure by means of one or more connected push pedestals 152, 154, 156, 158, 199, 198 to the non-aligned edges of the metal sheets or metal plates in the non-symmetrically stacked stack of metal sheets or metal plates and forcing said edges of the metal sheets or metal plates into abutment with one or more of the raised walls 121, 122, 124, 126, 128, 130 in a controlled manner, thereby causing the sheets or plates to be pushed into symmetrical alignment with each other from the top of the stack to the bottom of the stack.

Figure 7:
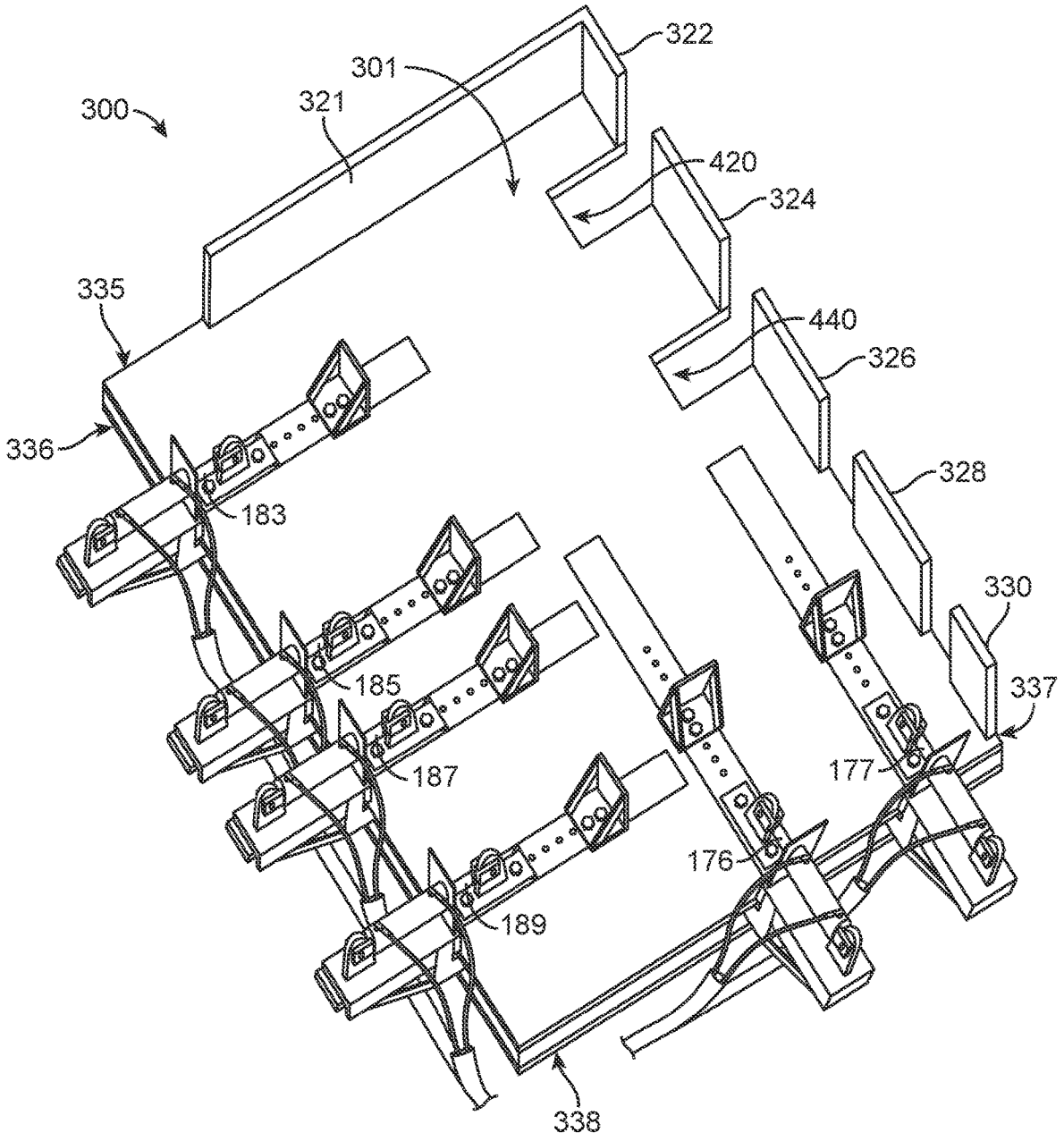
FIG. 7 is atop perspective view of another embodiment of the metal squaring table further illustrating features of such additional embodiment.
Figure 8:
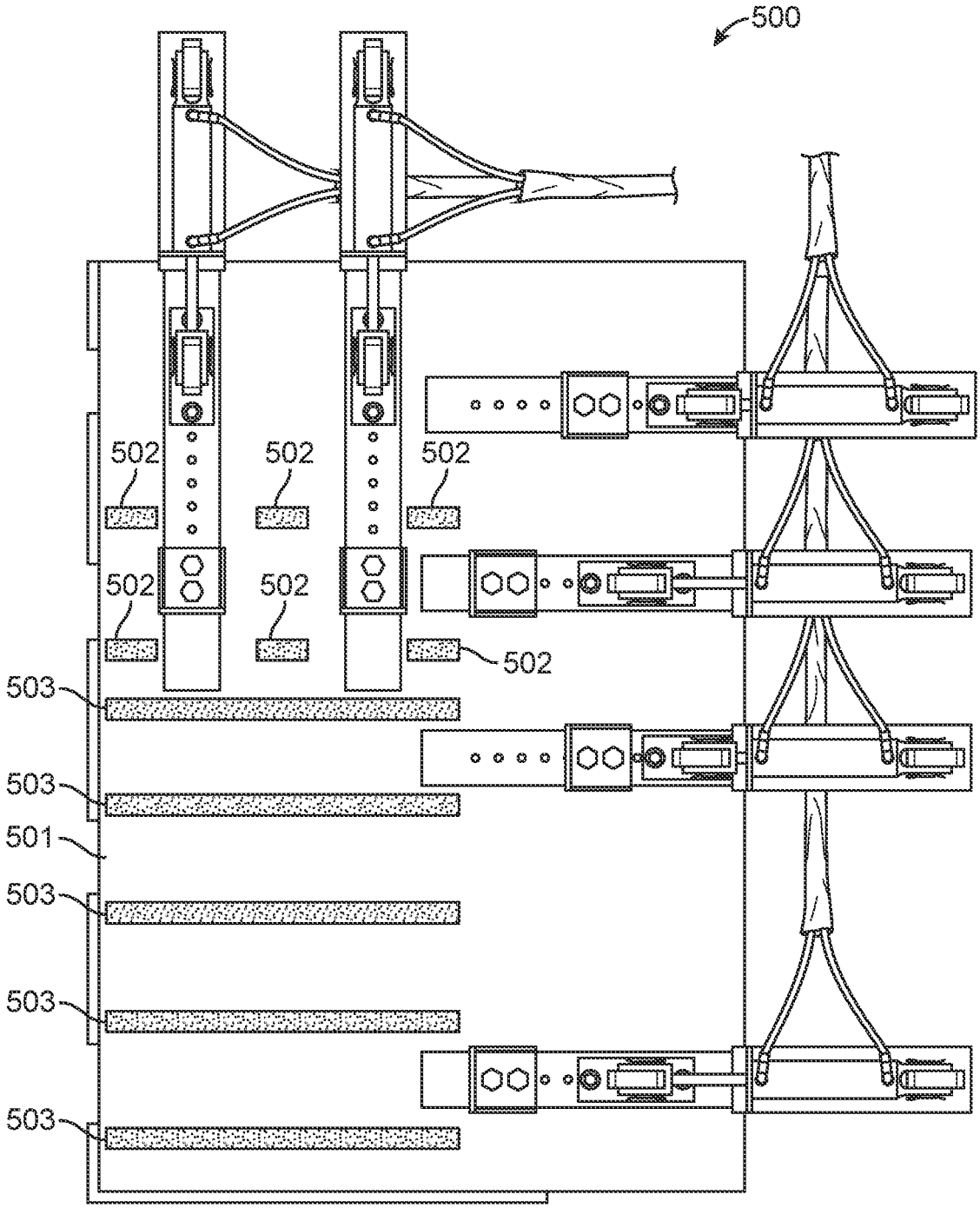
FIG. 8 is atop view of yet another embodiment of the metal squaring table illustrating additional features of that embodiment.

FIG. 7 illustrates another embodiment of a squaring table 300 with a top planar surface 301 and other features that are similar to the FIG. 6, except that in FIG. 7 there are table top openings 420, 440 provided on one of the orthogonal edges 337 of the table 300. The table top openings 420, 440 are optional, but when such table top openings 420, 440 are included, they facilitate the loading of the initial workpiece (W) and the unloading of the final workpiece (W') using the forks or tines of a front end loader or forklift.

Figure 9:
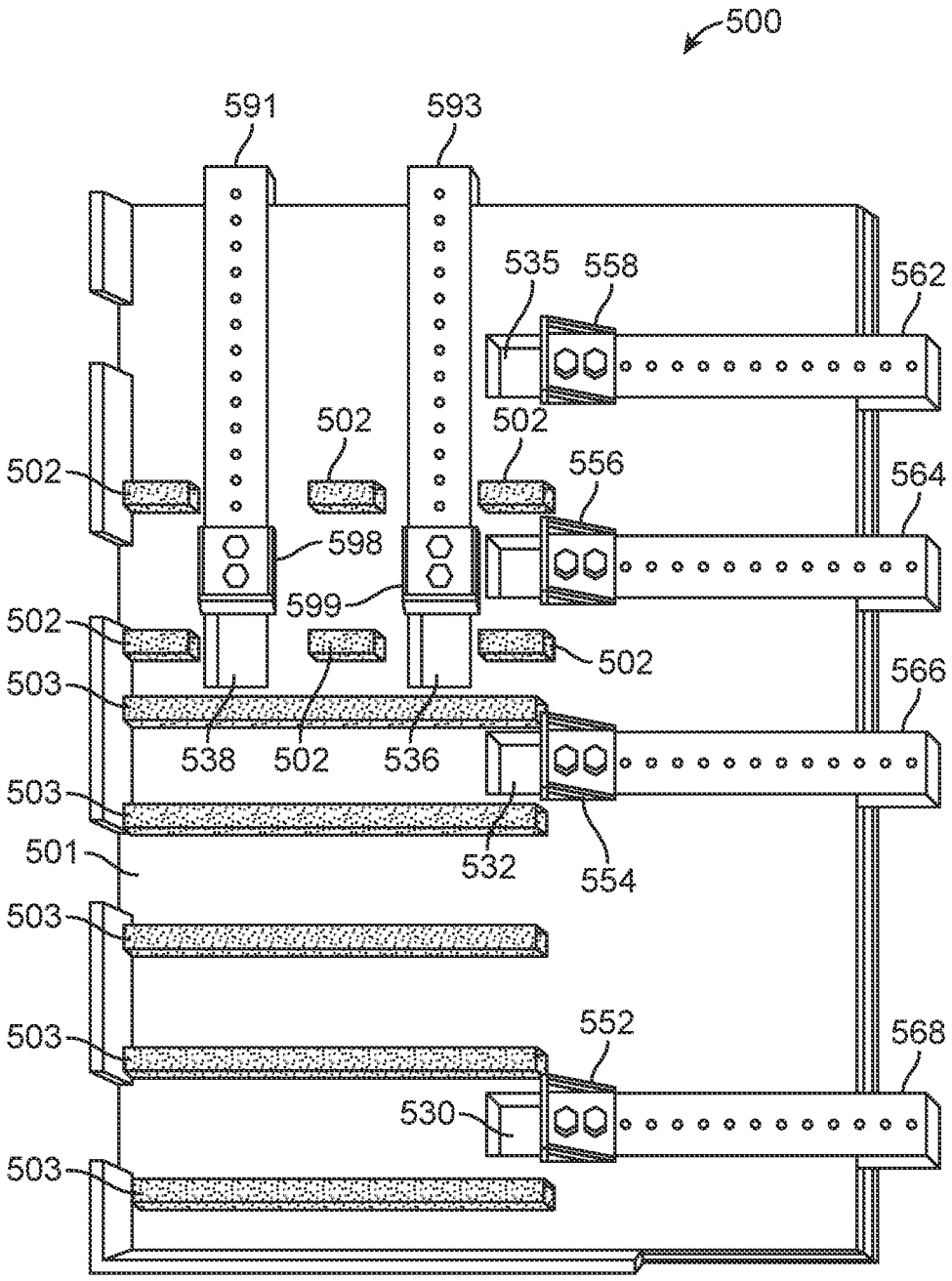
FIG. 9 is a top perspective view of the same embodiment of the metal squaring table as shown in FIG. 8, but with certain elements of the table omitted.
Figure 10:
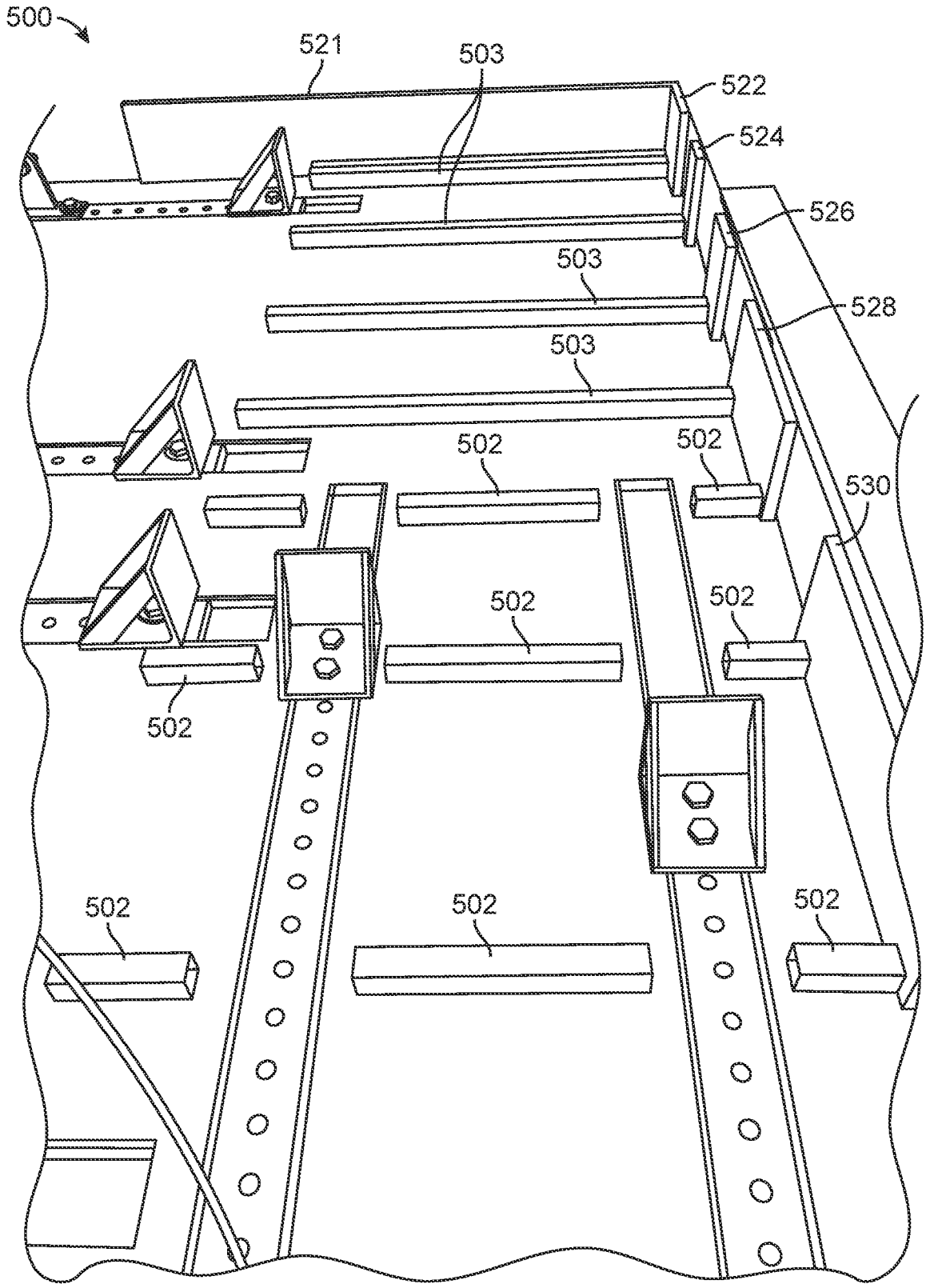
FIG. 10 is a perspective view of a portion of the metal squaring table previously shown in FIGS. 8-9.
Figure 11:
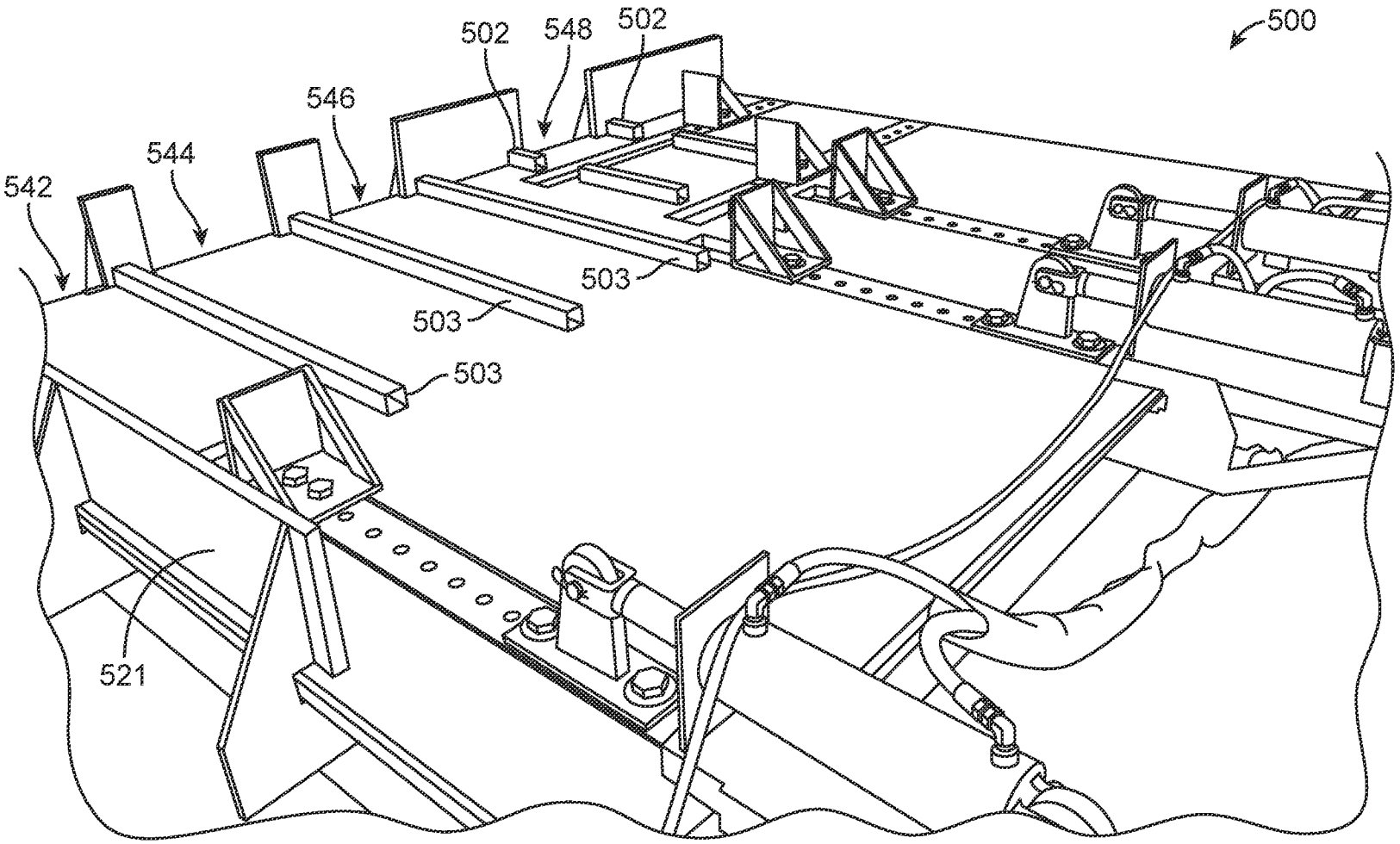
FIG. 11 is a different perspective view of a portion of the metal squaring table previously illustrated in FIGS. 8-10.

FIGS. 8-11 show yet another embodiment of the metal squaring table 500. This embodiment of the metal squaring table 500 is very similar to the embodiments shown in FIGS. 6-7, but this embodiment of the table 500 features a multiplicity of raised ribs, which in FIG. 9-11 are illustrated as main raised ribs 503 and supplemental raised ribs 502, all of which can be either removably or rigidly affixed to the table's top planar surface 501 in order to aid in squaring operations. Similar to other embodiments, the table 500 features main push pedestals 558, 556, 554, 552 that are removably connected to main slides 562, 564, 566, 568, and side push pedestals 598, 599 that are removably connected to side slides 591, 593. The raised ribs 502, 503 protrude vertically above the plane of the top planar surface 501, but the ribs 502, 503 do not protrude vertically above the planar surface 501 to the same extent as the push pedestals 558, 556, 554, 552, 598, 599. As can be understood, during squaring operations using the embodiment of the table 500 illustrated in FIGS. 8-11, when the metal sheets or metal plates are placed onto the table 500, the raised ribs 502, 503 will support the metal sheets and metal plates above the planar surface 501 such that the metal sheets and metal plates will not be in direct contact with the top planar surface 501 of the table 500. However, because the push pedestals 558, 556, 554, 552, 598, 599 extend vertically above the planar surface 501 and also vertically upward above the tops of the raised ribs 502, 503, when one or more of the slides 562, 564, 566, 568, 591, 593 are motivated forward by actuation means (shown, but not labeled in FIG. 8) the push pedestals 558, 556, 554, 552, 598, 599 push the edges of the metal sheets or metal plates into alignment in cooperation with the abutment means provided by the raised walls 522, 524, 526, 528, 530. As can be understood, the raised ribs 502, 503 may be useful in loading and onloading of the stacks of metal sheets or metal plates from the table 500 before and after squaring operations because the total frictional surface on which the metal sheets or metal plates are placed during squaring operations is reduced, and also because the raised ribs 502, 503 may provide spaces between the bottom of the stacks of metal sheets or metal plates and the planar surface 501 of the table 500 that will accommodate the forks or tines of a forklift or front end loader that may be used to load or unload the stacks of metal sheets or metal plates that are the workpieces for the invention.

Various prototypes of the invention have been built and shown to be operation using hydraulic rams connected on their proximal ends to hydraulic actuators located on two sides of the squaring table, with each of the rams being further connected on their distal ends by means of removable pin or bolt connections to slides that are disposed within recessed channels that serve as recessed tracks for the slides to move to and fro within the channels and below the level of the top planar surface of the table. The raised walls located along the two orthogonal edges of the table opposite from where the hydraulic rams are positioned may be either rigidly affixed to the orthogonal edges of the table, or may be removably connected, but in the prototypes that have been constructed, the raised walls were simply welded in place with good, sturdy welds. The push pedestals that are connected to the distal ends of the slides may be either rigidly affixed to, or removably connected to the slides, but with the prototypes the push pedestals have always been removably connected by bolts or pins to the distal ends of the slides.

In practice, the prototypes that have been built use a motor and pump connected to the hydraulic actuators for pushing or retracting the multiple hydraulic rams. In practice, the actuators connected on two sides of the squaring table can be used to push the rams forward along the surface of the squaring table during squaring operations applying uniform and constant pressure to each of the points of contact with the edges of the metal sheets or plates that are being squared. The actuators can obviously also be used to retract the rams back towards the actuators when the table is re-set for new squaring operations. Obviously, the pressure applied for squaring operations can be controlled by various valves so that uniform pressure or non-uniform pressure may be selectively applied with the various actuators and attached pushing rams, but a constant, uniform pressure being applied by the various actuators and pushing rams seems to work best during squaring operations. The actuators can potentially be mechanical motor actuators, hydraulic actuators, or pneumatic actuators. In a preferred embodiment, hydraulic actuators are used, with a separate motor and hydraulic pump providing hydraulic pressure for the extension or retraction of the rams/pistons. Furthermore, a pressure bypass valve has been used with the prototypes in order to selectively set the amount of pressure to be applied by the rams and therefore the pressure applied by the connected push pedestals against the edges of the stacked metal sheets or stacked metal plates. It is helpful to be able to control the pushing pressure that will be applied by adjusting the pressure upward or downward depending on the types/density/weight of metal sheets or metal plates that will undergo squaring using the squaring table. It is also an advantage of this invention that it can be used to apply a controlled, uniform amount of pressure at each push pedestal onto the edges of the metal sheets or metal plates in the initial non-symmetrically stacked stacks during squaring operations.

The removable connection means discussed in this application may be bolt connections, screw connections, or pin connections. The prototypes that have been constructed have made use of some pins for removable connections and some threaded bolts and threaded screw holes for other removable connections. The applicants realize that any of these types of connections would be possible for practicing the invention. Furthermore, the raised walls of this invention are described as being rigidly affixed to orthogonal edges of the table. Such rigid connection means could be in the form of welding, bolting, screwing, or otherwise rigidly connecting the raised walls to the edges of the table. Furthermore, the raised walls could also be an integral part of the table, for instance the table and raised walls could be cast as one single part or could be cut or otherwise formed from a single piece of material. Thus the manner in which the raised walls are rigidly affixed to the edges of the squaring table is not particularly relevant so long as the raised walls are stationary and provide sturdy surfaces protruding above the planar surface of the table for the metal sheets or metal plates to be pushed against during squaring operations. Likewise, the removable connections discussed with regard to the invention could potentially be replaced with rigid connection, such as for instance, welding, without departing from the inventive concept hereby disclosed.

The embodiments and other features, aspects, and advantages of the present invention may be best understood and appreciated with reference to the drawings, descriptions, and claims. Where used in the various figures of the drawings, the same numerals designate the same or similar parts. Furthermore, when the terms "top", "bottom", "forward", "backward", "front", "back", "distal", "proximal", "lateral", "vertical", "horizontal", "central", "first", "second", "third", "inside", "internal", "outside", "external", "end", "ends", "side", "sides", "edge", "edges" and similar terms are used herein, it should be understood that, unless otherwise specifically stated or otherwise made specifically clear by context, these terms have reference only to the structure shown in the drawings as it would appear to a person viewing the drawings, and such terms are to be utilized in connection with the appended drawings in order to facilitate describing the invention and in order to facilitate a better understanding of the invention.

Although the invention has been described with reference to several specific embodiments, this description is not meant to be construed in a limiting sense. Various modifications of the disclosed embodiments, as well as alternative embodiments of the invention, will be apparent to persons skilled in the art upon reference to the description of the invention. It is, therefore, contemplated that the appended claims will cover such modifications that fall within the scope of the invention.

What we claim is:

1. A table for aligning the edges of stacked metal sheets or metal plates that is comprised of:

a planar surface;

a first wall that is rigidly affixed to a first edge of the table and protrudes above the planar surface;

a second wall that is rigidly affixed to a second edge of the table and protrudes above the planar surface;

wherein the second wall is orthogonal to the first wall;

a first pushing ram slidably connected to a third edge of the table that is opposite the first edge of the table, wherein the first pushing ram can be selectively slid toward or away from the first wall;

a second pushing ram slidably connected to a fourth edge of the table that is opposite the second edge of the table, wherein the second pushing ram can be selectively slid toward or away from the second wall;

a third wall that is rigidly affixed to the first edge of the table and protrudes above the planar surface;

wherein the third is separated from the first wall by a first wall opening that serves as an access point for a forklift or frontend loader to load unload metal sheets with respect to the planar surface of the table.

2. The table of claim 1 further comprising:

a fourth wall that is rigidly affixed to the first edge of the table and protrudes above the planar surface;

wherein the fourth call is separated from the third wall by a second wall opening.

3. The table of claim 1 further comprising:

a first table top opening that is a continuation of the first wall opening and is an opening through the planar surface of the table that extends a portion of the distance from the first edge to the third edge.

4. The table of claim 2 further comprising:

a first table top opening that is a continuation of the first wall opening and is an opening through the planar surface of the table that extends a portion of the distance from the first edge to the third edge;

a second table top opening that is a continuation of the second wall opening and is an opening through the planar surface of the table that extends a portion of the distance from the first edge to the third edge.

5. The table of claim 1 further comprising:

a first actuation means connected to the first pushing ram wherein the first actuation means can be used to push the first pushing ram toward the first edge of the table or retract the first pushing ram away from the first edge;

a second actuation means connected to the second pushing ram wherein the second actuation means can be used to push the second pushing ram toward the second edge of the table or retract the second pushing ram away from the second edge.

6. The table of claim 1 further comprising a multiplicity of raised ribs that are affixed to the planar surface of the table and protrude from the planar surface, but not to the extent of the walls, wherein each raised rib has its own top surface that is parallel to the planar surface of the table.

7. The table of claim 4 further comprising a multiplicity of raised ribs that are affixed to the planar surface and protrude from the planar surface, but not to the extent of the raised walls.

8. A squaring table for use in aligning the edges of stacks of metal sheets or metal plates comprised of:

four edges;

a top planar surface;

a first raised wall attached to one of the edges and protruding vertically upward above the top planar surface;

a second raised wall attached to a second edge and protruding vertically upward above the top planar surface;

wherein the first raised wall is orthogonal to the second raised wall;

a multiplicity of raised ribs that are affixed to the planar surface of the table and protrude from the planar surface, but not to the extent of the walls, wherein each raised rib has its own top surface that is parallel to the planar surface of the table;

at least two openings disposed within at least one of the raised walls.

9. The table of claim 8 further comprised of channels in the planar surface of the table communicating with the openings within the at least one raised wall.

10. The table of claim 9 further comprised of a multiplicity of pushing rams connected to the table that are capable of being motivated toward the raised walls.

11. The table of claim 10 further comprising push pedestals connected to the pushing rams wherein the push pedestals protrude above the top planar surface of the table and above the tops of the raised ribs.

12. The table of claim 11 wherein the push pedestals are interconnected to the pushing rams by means of slides that are disposed within the channels that extend below the top planar surface of the table.

13. The table of claim 12 wherein the push pedestals are removably connected to the slides and the slides are further removably connected to the pushing rams by removable connection means, and the pushing rams are connected to actuation means.

14. A table for squaring metal sheets or metal plates comprised of a top planar surface;

a multiplicity of raised ribs that are affixed to the planar surface of the table and protrude from the planar surface, but not to the extent of the wall, wherein each raised rib has its own top surface that is planar and is parallel to the top planar surface of the table;

four edges;

a wall connected to at least two of said edges of the table and extending vertically upward from the planar surface, and wherein said wall defines a corner on the table where the wall features a first wall planar surface and a second wall planar surface that are orthogonal to each other;

at least two openings disposed within the first wall planar surface;

at least two pushing rams connected to the table, wherein one pushing ram is retractably extendable toward the first wall planar surface and wherein a second pushing ram is retractably extendable toward the second wall planar surface;

wherein the ends of the pushing rains facing the respective orthogonal wall planar surfaces are positioned above the top planar surface of the table;

channels in the top planar surface of the table communicating with the openings within the first wall planar surface;

push pedestals interconnected to the pushing rams wherein the push pedestals protrude vertically above the top planar surface of the table and above the top surface of the raised ribs, but not beyond the top of the wall;

wherein the push pedestals are interconnected to the pushing rams by means of slides that are slidably disposed within the channels;

hydraulic actuation means for actuating the pushing rams forward or backward with respect to their respective opposing wall planar surfaces such that the interconnected push pedestals are thereby moved forward or backward during metal plate squaring operations.

* * * * *